US007187129B2

(12) United States Patent
Piena

(10) Patent No.: US 7,187,129 B2
(45) Date of Patent: Mar. 6, 2007

(54) HIGH PRESSURE GAS DISCHARGE LAMP AND METHOD OF MANUFACTURING THE SAME

(75) Inventor: Martinus Johannes Piena, Eindhoven (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 28 days.

(21) Appl. No.: 10/480,420

(22) PCT Filed: Jun. 20, 2002

(86) PCT No.: PCT/IB02/02412

§ 371 (c)(1),
(2), (4) Date: Dec. 11, 2003

(87) PCT Pub. No.: WO03/001563

PCT Pub. Date: Jan. 3, 2003

(65) Prior Publication Data

US 2004/0155587 A1 Aug. 12, 2004

(30) Foreign Application Priority Data

Jun. 25, 2001 (EP) ..... 01202432

(51) Int. Cl.
*H01J 61/04* (2006.01)

(52) U.S. Cl. ..... 313/631; 313/574; 313/621

(58) Field of Classification Search ..... 313/631, 313/574, 270, 571, 576, 632, 638–643, 621; 445/35, 46, 48, 49, 52, 34
See application file for complete search history.

(56) References Cited

U.S. PATENT DOCUMENTS

| | | | | |
|---|---|---|---|---|
| 4,606,997 | A * | 8/1986 | Kira | 430/311 |
| 4,988,918 | A * | 1/1991 | Mori et al. | 313/641 |
| 5,081,396 | A * | 1/1992 | Schneider et al. | 313/630 |
| 5,210,463 | A * | 5/1993 | Fromm et al. | 313/631 |
| 5,539,273 | A * | 7/1996 | Sims | 313/335 |
| 6,137,999 | A | 10/2000 | Lovelace et al. | 455/302 |
| 6,211,615 | B1 * | 4/2001 | Altmann et al. | 313/631 |
| 2001/0052754 | A1 * | 12/2001 | Miyanaga | 313/632 |
| 2002/0163307 | A1 * | 11/2002 | Serizawa et al. | 313/642 |
| 2003/0155864 | A1 * | 8/2003 | Wada et al. | 313/631 |

FOREIGN PATENT DOCUMENTS

WO WO9832221 7/1998

OTHER PUBLICATIONS

F. Aschwanden: "Direct Conversion How to Make it Work in TV Tuners" IEEE Transactions on Consumer electronics, vol. 42, No. 3, Aug. 1, 1996, pp. 729-738. XP000638561, NY.

* cited by examiner

*Primary Examiner*—Karabi Guharay
*Assistant Examiner*—Anthony Canning

(57) ABSTRACT

High pressure vapor discharge lamp provided with a discharge vessel. The discharge vessel encloses a discharge space provided with a filling of mercury and a rare gas, for example, in a gastight manner. An electrode is arranged in the discharge space for generating and maintaining a discharge therein, while the electrode comprises a rod electrode having an enlarged head at its end which projects into the discharge space. According to the invention, the enlarged head comprises a preformed electrode projection having an at least substantially conical shape.

9 Claims, 2 Drawing Sheets

HIGH PRESSURE GAS DISCHARGE LAMP AND METHOD OF MANUFACTURING THE SAME

Figure 1:
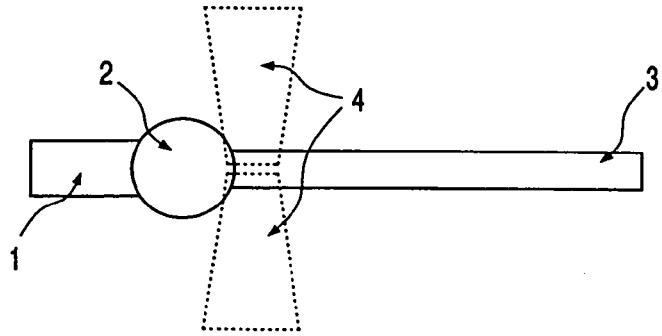

The invention relates to a high-pressure gas discharge lamp (so-termed HID (high intensity discharge) lamps or UHP (ultra high performance) lamps), in particular mercury vapor lamps with a filling grade of between approximately 0.05 and 0.5 mg/mm$^3$, comprising a discharge vessel which encloses a discharge space provided with a filling of, for example, mercury and a rare gas in a gastight manner, and also comprising at least one electrode for generating and maintaining a discharge in the discharge space, said electrode comprising an electrode rod which is provided with a widened electrode head at its end projecting into the discharge space. The invention also relates to a method of manufacturing such a lamp.

The manufacture, the operating characteristics, the operational life, and the cost of such a high-pressure gas discharge lamp are mainly determined by the type and specific shape of the electrodes used. Many geometric electrode shapes have been developed in the course of time for taking into account the above lamp aspects to a higher or lower degree. In the simplest case, the high-pressure gas discharge lamp comprises two electrodes, each formed by a tungsten wire or rod. The free ends of the electrode rods extend into the discharge space, which is filled, for example, with mercury and a rare gas and in which a light arc is formed in the operational state. The other ends of the electrode rods are connected to connection pins via a gastight lead-through construction present in the discharge vessel so as to obtain a desired operating voltage.

It is known to provide one or several windings of the same material as the electrode material on the free ends of the electrodes, in particular for the purpose of improving the heat radiation of the electrodes and of avoiding an excessive heating-up of the lead-through construction mentioned above, in the case of a high lamp power, and thus avoiding the risk of damage to the seal of the discharge vessel. These windings may be fused to the respective electrode rod, if so desired, so as to perform the function of a heat buffer in particular in lamps operating on an AC voltage. In addition, the useful life of the electrodes can be prolonged thereby. Electrodes of this type are made from tungsten in a simple manner and are generally known.

A major disadvantage of these known electrodes is that the thermal conduction is usually comparatively small and not reproducible because the thermal contact between the windings and the rod, as well as that between the windings themselves, is subject to changes during lamp life. These effects may lead to changes in the lamp characteristics, especially in lamps with short light arcs (for example approximately 1 mm). These problems are indeed present in lamps with short light arcs (for example, the UHP lamps mentioned above) irrespective of whether the windings are fused to the rod or not, because such lamps operate at very high operational temperatures whereby the fused portions may become changed. Electrodes manufactured from a sturdy, solid tungsten rod for counteracting these problems are expensive and complicated in their manner of manufacture.

U.S. Pat. No. 3,067,357 discloses an electrode whose electrode rod has a widened head of spherical shape obtained through fusion. The heat necessary for fusion may be provided either during manufacture or during operation of the lamp, the size of the sphere and thus at the same time the distance between the electrodes being determined by the lamp current, the pressure in the discharge vessel, and the diameter of the electrode rods. During operation, however, a major portion of the widened head (for example 50%) must remain in the molten state. The manufacture of the electrodes thus becomes simpler and cheaper because the size of the spherical widened head to which the light arc attaches itself is determined through setting of the parameters mentioned above and accordingly not by external influences of the manufacturing and assembling techniques which are subject to tolerances.

A disadvantage of the high-pressure gas discharge lamp known from this US patent is that the lamp current is to be accurately adjusted and is to be kept constant so as to shape the spherical widened head in an accurate manner and keep it in the molten state to the required degree. A lamp current which is a few per cents too high may have the result here that the entire assembly of the widened head and the electrode rod melts, so that the widened head becomes bigger and the distance between the mutually opposed electrodes changes considerably and for a longer period. This disadvantage is indeed so grave in the case of lamps with short light arcs that the current must be set with very high accuracy so as to have this type of lamps with such electrodes operate in a stable manner. Added to this is that this limit current changes during switching-on in dependence on the pressure of, for example, the mercury vapor in the discharge vessel.

Another disadvantage of the high-pressure gas discharge lamp described in the cited U.S. patent is that the distance between the electrodes changes during lamp life. This is caused by the iodine present in the discharge vessel which serves to prevent blackening of the lamp, but which at the same time causes the transport of tungsten from the hot electrode end to the rear portion of the electrode to take place more quickly. This phenomenon is the more disadvantageous in the case of lamps with short light arcs, as they have a useful life of only a few hundred hours with such electrodes.

It is an object of the invention to counteract the disadvantages of the prior art in the sense that a high-pressure gas discharge lamp is provided which can be manufactured in a simple and economical manner, which has a long life and an at least substantially constant distance between the electrodes, and which operates in a stable and permanent manner throughout its life without special measures having to be taken for keeping the lamp current accurate and constant.

To achieve this object, according to the invention, a high-pressure gas discharge lamp of the kind mentioned in the opening paragraph is characterized in that the electrode head comprises a preformed electrode projection of at least substantially conical shape. In particular, this electrode projection becomes thinner towards its free end (i.e. the end projecting into the discharge space). The following recognition surprisingly led to the invention. A tapering, i.e. pointed shape of the electrode projection, as seen in longitudinal sectional view, has the particular result that a light arc will apply itself exactly to the tip thereof in the operational state, so that the electrode projection will melt exactly in this location. The thicker portion, in relation to the tip, of the electrode projection has a relatively greater mass and thus acts as a heat buffer, so that the electrode rod will have substantially lower temperatures in its remaining portion. The lamp has a long useful life as a result of this. The preformed electrode projection of conical shape is found to obtain its definitive shape during the first hours of operation of the lamp in practice, so that the interspacing of the electrodes remains constant.

In a preferred embodiment of a high-pressure gas discharge lamp according to the invention, the electrode projection has a cone height which varies between 150 and 600 μm, in particular between 200 and 500 μm, more in particular between 250 and 400 μm. Independently thereof or in combination therewith, the electrode projection preferably has a cone base diameter which varies between 200 and 700 μm, in particular between 300 and 650 μm. Independently thereof or in combination therewith, the electrode projection in particular has a cone tip diameter which varies between 150 μm and 600 μm, in particular between 200 and 500 μm.

As was noted above, the invention also relates to a method of manufacturing a high-pressure gas discharge lamp according to the invention, whereby the electrode rod of the electrode is provided with a widened head at its end which is to project into the discharge space, after which a rod-shaped member is fastened to the widened head such that the portion of the rod-shaped member facing the widened head of the electrode rod is given an at least substantially conical shape, whereupon the remaining portion of the rod-shaped member is removed.

In a preferred embodiment of a method according to the invention, the rod-shaped member is welded to the widened head of the electrode rod. This is preferably done by means of a laser. In particular, several lasers and several optical elements, for example three optical elements, positioned around the portion of the rod-shaped member facing the widened head of the electrode rod are used. The angle enclosed between any two of the optical elements is then preferably 120°. It is obviously also possible to use one laser whose beam is split up into three component beams. These component beams are conducted through fibers to three optical elements which direct the component beams and focus them on the rod-shaped member.

In a further preferred embodiment of a method according to the invention, the remaining portion of the rod-shaped member is broken off.

Figure 5:
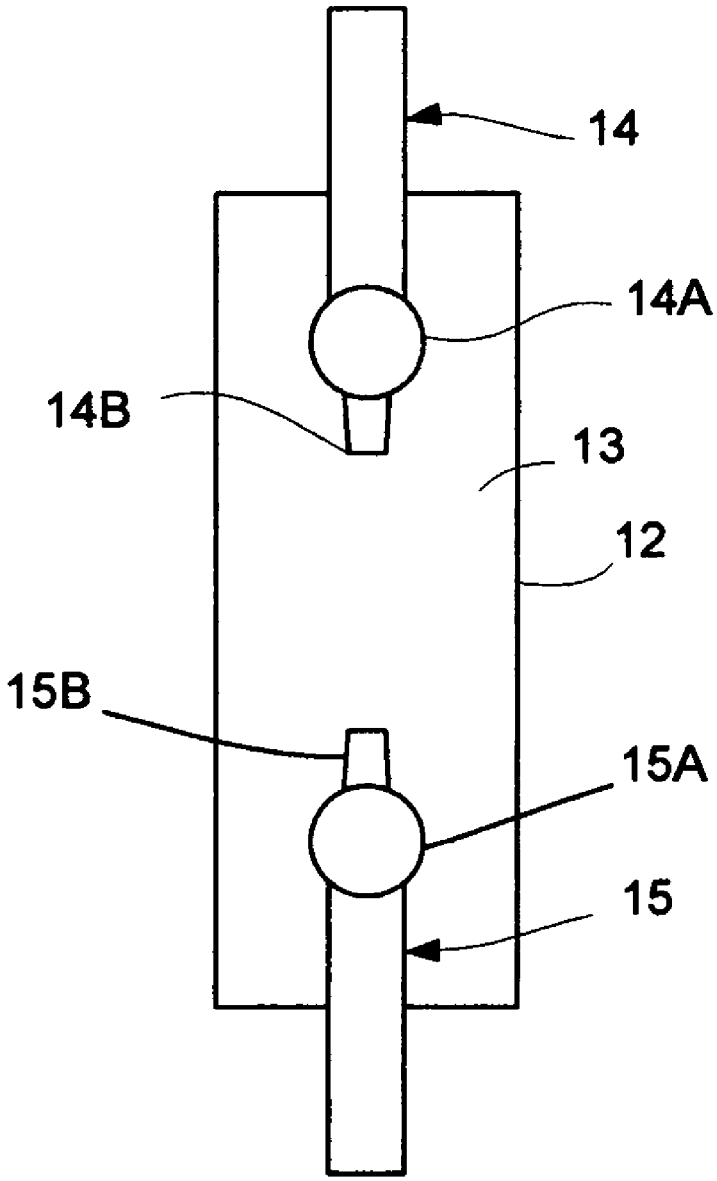

The invention will now be explained in more detail with reference of Figures in a drawing, in which FIGS. 1 to 4 diagrammatically illustrate a number of consecutive steps of the method of manufacturing the electrode according to the invention, and FIG. 5 diagrammatically illustrates a high-pressure discharge lamp incorporating a pair of electrodes according to the invention.

Figure 2:
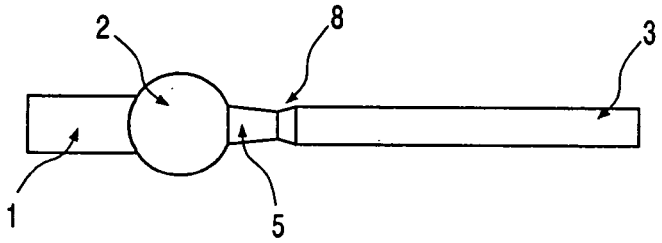
Figure 3:
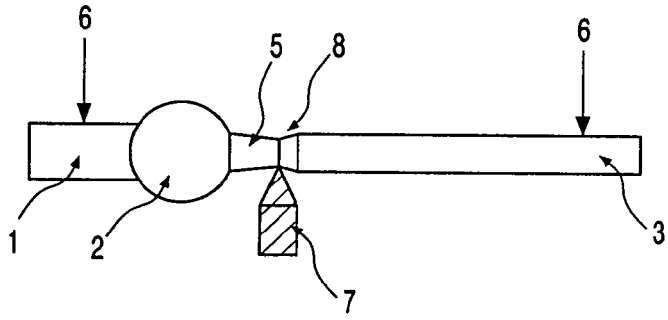
Figure 4:
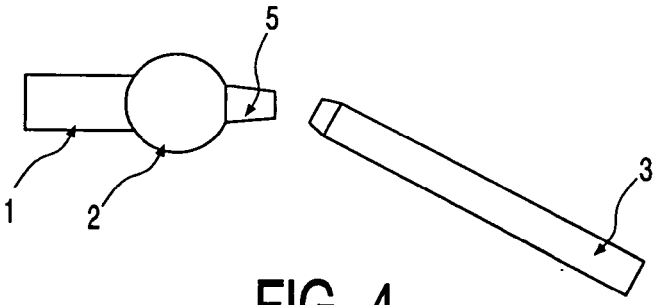

FIG. 1 shows an electrode for a high-pressure gas discharge lamp according to the invention, comprising an electrode rod 1 whose free end extending into the discharge space has a widened, spherical electrode head 2. A conical electrode projection is formed at this electrode head 2 in the following manner. A rod-shaped member 3 of the same material as the electrode rod 1 is welded to the widened electrode head 2 of the electrode rod 1 by means of an energy source, for example with three lasers 4 or alternatively through high-frequency heating, or with a discharge arc, such that the lasers 4 are arranged around the end portion of the rod-shaped member 3 facing the widened electrode head 2, i.e. enclosing an angle of 120° with one another (viewed in a plane perpendicular to the rods 1, 3, see FIG. 1). As FIG. 2 shows, said end portion of the rod-shaped member 3 is given a substantially conical shape thereby: the eventual conical electrode projection 5. The entire assembly is then pressed onto a subjacent support 7 in the direction of arrows 6 at the area of a narrowed portion 8 of the rod-shaped member 3 (FIG. 3). As a result, the remaining portion of the rod-shaped member 3 will be broken off, so that the widened electrode head 2 is now provided with a pre-formed conical electrode projection 5 narrowing in outward direction so as to have the shape of a truncated cone.

FIG. 5 shows diagrammatically a high-pressure discharge lamp of the invention, including a discharge vessel 12 enclosing a gas-tight discharge space 13, and a pair of electrodes 14 and 15 having widened heads 14A and 15A and conical projections 14B and 15B, respectively, in accordance with the invention.

It is noted that the present invention is not limited to the embodiment described above, but that it also covers alternative versions which fall within the scope of the appended claims. It will thus be obvious to those skilled in the art that the rod-shaped member 3 may be made from a material different from that of the electrode rod 1: the present invention indeed offers the possibility of using different materials for the conical electrode projection 5 on the one hand and the widened electrode head 2 on the other hand.

The invention claimed is:

1. A high-pressure gas discharge lamp comprising a discharge vessel which encloses a discharge space provided with a discharge-sustaining filling in a gastight manner, and also comprising at least one electrode for generating and maintaining a discharge in the discharge space, said electrode comprising an electrode rod which is provided with a widened electrode head at its end projecting into the discharge space, characterized in that the electrode head comprises a preformed electrode projection of at least substantially conical shape, the projection having a cone height which varies between 150 and 600 μm, the projection having a free end projecting into the discharge space.

2. A high-pressure gas discharge lamp as claimed in claim 1, wherein the electrode projection becomes narrower towards its free end.

3. A high-pressure gas discharge lamp as claimed in claim 1, wherein the electrode projection has a cone height which varies between 200 and 500 μm.

4. A high-pressure gas discharge lamp as claimed in claim 3, wherein the electrode projection has a cone height which varies between 250 and 400 μm.

5. A high-pressure gas discharge lamp as claimed in claim 1, wherein the electrode projection has a cone base diameter which varies between 200 and 700 μm.

6. A high-pressure gas discharge lamp as claimed in claim 5, wherein the electrode projection has a cone base diameter which varies between 300 and 650 μm.

7. A high-pressure gas discharge lamp as claimed in claim 1, wherein the electrode projection has a cone tip diameter which varies between 150 μm and 600 μm.

8. A high-pressure gas discharge lamp as claimed in claim 7, wherein the electrode projection has a cone tip diameter which varies between 200 and 500 μm.

9. A high-pressure gas discharge lamp as claimed in claim 1, wherein the filling comprises mercury and a rare gas.

* * * * *